United States Patent [19]

Nawa et al.

[11] 4,161,153

[45] Jul. 17, 1979

[54] THREAD WINDING MECHANISM FOR SEWING MACHINE

[75] Inventors: Hideo Nawa, Chiryu; Yujiro Takikawa, Toyota, both of Japan

[73] Assignee: Aisin Seiki Kabushiki Kaisha, Aichi, Japan

[21] Appl. No.: 852,749

[22] Filed: Nov. 18, 1977

[30] Foreign Application Priority Data

Nov. 18, 1976 [JP] Japan ..... 51/153867[U]

[51] Int. Cl.[2] ..... D05B 59/00; B65H 54/18

[52] U.S. Cl. ..... 112/279; 112/220

[58] Field of Search ..... 112/271, 279, 220; 242/20, 22, 23

[56] References Cited

U.S. PATENT DOCUMENTS

| | | | |
|---|---|---|---|
| 3,123,034 | 3/1964 | Okazaki | 112/220 |
| 3,670,974 | 6/1972 | Ueltschi | 112/279 X |
| 4,033,273 | 7/1977 | Kasuga | 112/279 X |

FOREIGN PATENT DOCUMENTS

| | | | |
|---|---|---|---|
| 2650347 | 5/1977 | Fed. Rep. of Germany | 112/279 |
| 228625 | 12/1943 | Switzerland | 112/279 |

*Primary Examiner*—H. Hampton Hunter

*Attorney, Agent, or Firm*—Oblon, Fisher, Spivak, McClelland & Maier

[57] ABSTRACT

A thread winding mechanism including a thread winding shaft and a clutch member for disconnecting a torque transmission between a main shaft of a sewing machine and a drive pulley. Once the bobbin is manually inserted into the thread winding shaft the clutch member is automatically actuated to disconnect the main shaft from the drive pulley for preparation of the thread winding operation.

4 Claims, 6 Drawing Figures

THREAD WINDING MECHANISM FOR SEWING MACHINE

BACKGROUND OF THE INVENTION

1. Field of the Invention

This invention relates generally to sewing machines and more particularly to a thread winding mechanism for a sewing machine.

2. Description of the Prior Art

Conventionally, during thread winding operation it has been difficult to recognize whether the rotation of the main shaft of the machine is actually stopped or not. Accordingly, if the operator of the machine erroneously depressed the pedal in spite of the machine being not yet changed to a thread winding condition, the main shaft is then rotated to vertically reciprocate the needle and needle bar, which might result in a dangerous condition if a person has put their hand in the needle operating area of the machine, or the cloth might otherwise be erroneously stitched if it remains within the sewing area.

SUMMARY OF THE INVENTION

It is, therefore, an object of the invention to provide an improved thread winding mechanism, wherein once the bobbin is inserted into the winding shaft, the main shaft as well as a hand wheel is simultaneously prevented from the the rotation thereof.

It is another object of the present invention to provide a compactly constructed and easily operable thread winding mechanism of a sewing machine.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
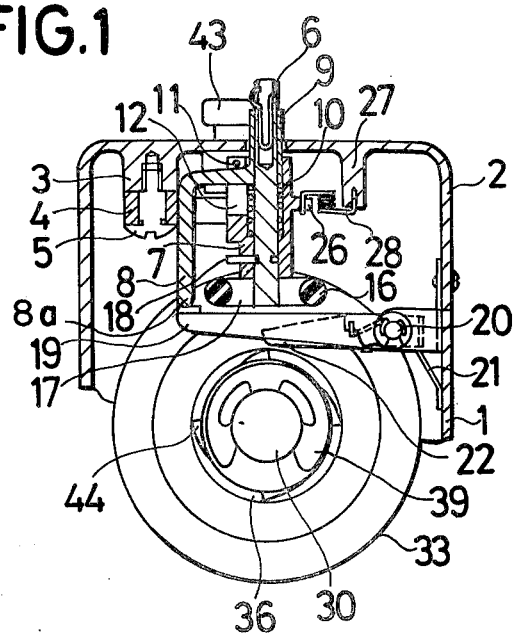
FIG. 1 shows a cross-sectional view of the present invention.

Referring now to the FIGURES, numeral 1 designates an arm of sewing machine which is covered by arm cover 2. A downwardly projecting boss portion 3 is formed integrally with the arm cover 2 at the interior thereof. A guide member 4 is rotatably mounted on boss portion 3 by means of screw bolt 5 for controlling the rotation of a thread winding shaft 6. Guide member 4 further includes a lever member 7 formed integrally with guide member 4 and a bearing means 9 slidably mounted on the outer surface of thread winding shaft 6.

Bearing means 9 has a downwardly extending lever portion 8 while a compression spring 10 is provided between the lever member 7 and the undersurface of bearing means 9 for always biasing bearing means 9 in an upward direction. The upward movement of bearing means 9 relative to the thread winding shaft 6 is limited by a stopper pin 11 provided in lever member 7. Lever member 7 has a recess portion 12 which is provided for preventing lever portion 8 from rotation as well as for guiding the up and down movement thereof.

The upper end of thread winding shaft 6 extends from arm cover 2 for inserting a bobbin 13 (see FIG. 2) thereon. A stopper spring 14 is disposed in the upper end portion of thread winding shaft 6 for preventing the bobbin 13 inserted therein from projecting therefrom during the thread winding operation. Spring 14 is engaged with a recess 15 on shaft 6 when bobbin 13 is inserted into shaft 6. The lower end of the thread winding shaft 6 is secured to a pulley 17 having a rubber roller 16 thereon.

The lowermost end **8*a* of lever portion 8 is in contact with one end 19*a* of a lever 19 which is pivotally mounted on a shaft 20 secured to arm cover 2 by a support plate 50. Lever 19 is biased to be in contact with lever portion 8 by means of spring 21 wound around the outer periphery of shaft 20. Another spring 23 is also wound around shaft 20 for biasing another cam lever 22 which is also pivotally mounted on shaft 20**.

Due to the biasing force of spring 23 cam lever 22 will be forced to move integrally with the lever 19. Cam lever 22 is engaged with a projection 25 of the lever 19 for restricting the rotational movement of lever 22 in one direction.

Figure 5:
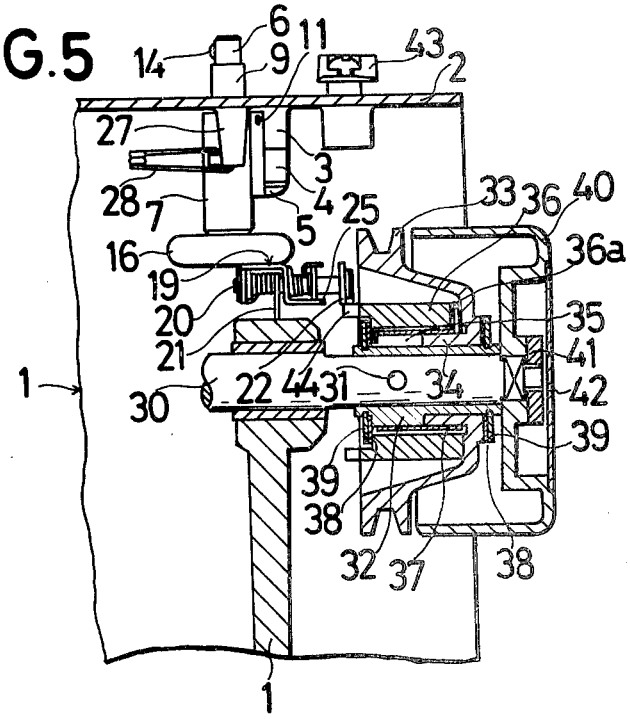
FIG. 5 shows a side cross-sectional view of the present invention.

A quick motion or snap action spring 28 is provided between a hook 26 of lever member 7 and an inward projection 27 of arm cover 2. The rotational movement of lever member 7 is limited by a stopper 29 secured to arm cover 2. Main or upper shaft 30 is rotatably supported on the arm 1 and one end, i.e. the right end as viewed in FIG. 5, is secured to a hand wheel 40 by means of a nut 41 for unitary rotation. A sleeve member 32 is secured to the main shaft 30 by means of a pin 31 for unitary rotation while a drive pulley 33 is mounted on sleeve member 32 for transmitting rotational torque from a motor (not shown) to main shaft 30 by drive belt means (also not shown) on pulley 33.

Figure 6:
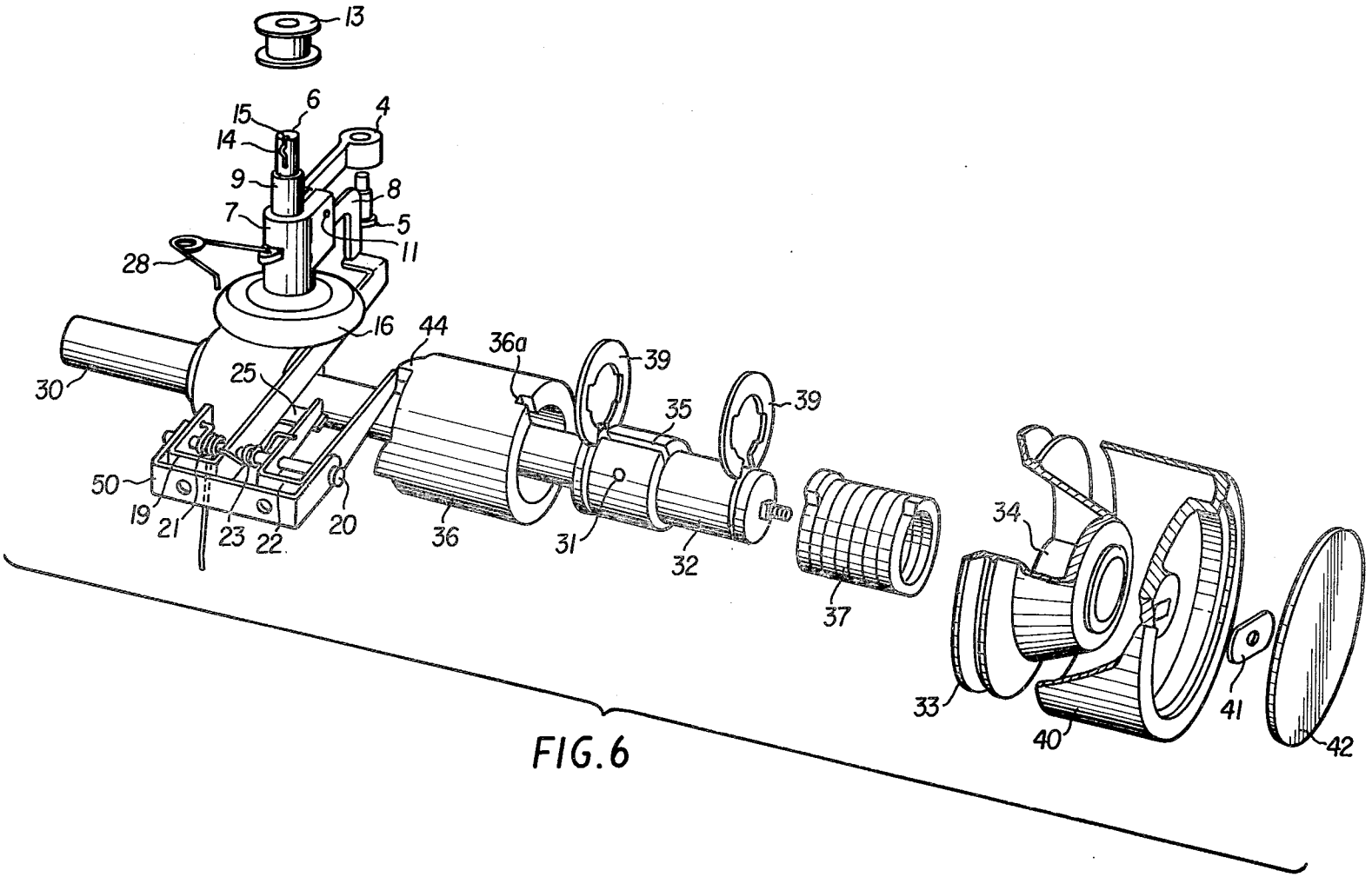
FIG. 6 shows a disassembled view of the embodiment of FIG. 5.

A clutch spring 37 is disposed on the outer periphery of sleeve 32 and of boss portion 34 of the pulley 33 in winding manner and one end of spring 37 is secured to a recess 35 provided on sleeve member 32. A cam bushing 36 is disposed along the outer periphery of clutch spring 37 such that spring 37 is positioned between the inner surface of bushing 36 and the outer surfaces of sleeve member 32 and boss portion 34 of pulley 33. The other end of spring 37 is secured to a radial groove **36*a* provided on the inner end of bushing 36. The assembly including sleeve member 32, pulley 33 clutch spring 37 and bushing 36 is defined in its assembled position by a pair of washers and disk springs 38, 39 provided at both ends of the assembly as clearly shown in FIGS. 5 and 6**.

A cover 42 is provided for hand wheel 40 and a stopper 43 is provided on the arm cover adjacent to the upper end of thread winding shaft 6 for stopping the thread winding operation of bobbin 13 and the shaft 6 when the thread is sufficiently wound upon bobbin 13. A plurality of pawls 44 (in the preferred embodiment, four are utilized) are provided at cam bushing 36 for engaging with cam lever 22 when lever 22 is actuated.

In operation, when bobbin 13 is not inserted into thread winding shaft 6, that is, when the sewing machine is under normal sewing operation, the torque from the motor is transmitted to main shaft 30 through pulley 33 and sleeve member 32. At this time, bushing 36 is also rotated by clutch spring 37 disposed between sleeve member 32 and bushing 36. Since hand wheel 40 is secured to main shaft 30, it may rotate when shaft 30 is rotating.

Figure 2:
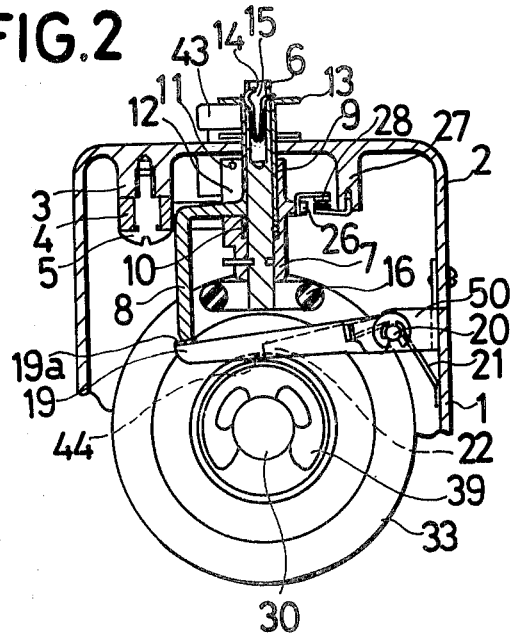
FIG. 2 is similar to FIG. 1 but showing the thread winding operation being initiated.

Next, when the operator of the machine wishes to supply thread with the bobbin, bobbin 13 is first inserted into the exposed upper end of thread winding shaft 6 and, upon insertion of bobbin 13, bearing means 9 is forced to be moved downward by the operation of insertion bobbin 13 which is moved down until spring 14 engages with recess 15 of shaft 6 to hold the bobbin in its operative position as shown in FIG. 2. The bearing means 9 is thus moved downward against the force of spring 10 to thereby push down end 19*a* of lever 19 by lever portion 8 of bearing means 9.

When lever 19 is swung about the shaft 20 in a counterclockwise direction as viewed in FIG. 2 thus overcoming the biasing force of spring 21 thereon, then, due to the rotational movement of lever 19, another cam lever 22 is also initiated to be swung in the same direction to lever 19 through the force of spring 23. The free end of lever 22 is then engaged with one of the pawls 44 provided on the bushing 36 to thereby prevent cam busing 36 from rotation.

Figure 3:
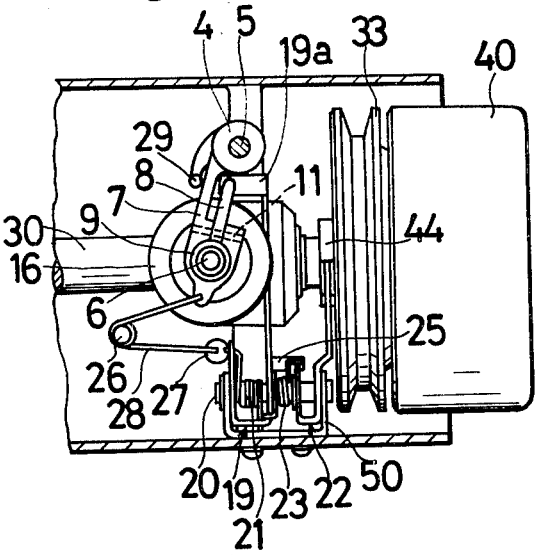
FIG. 3 shows a plan view of the invention after removing the arm cover therefrom.
Figure 4:
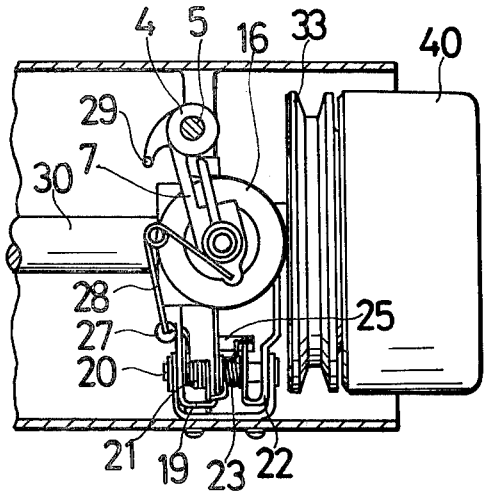
FIG. 4 is similar to FIG. 3 but showing the thread winding mechanism while under operation.

Since the inner end of clutch spring 37 is engaged with groove 36*a* of bushing 36, the frictional engagement between spring 37 and boss 34 of the pulley 33 will be released and thus, the rotational torque of the motor will not be transmitted to main shaft 30 as well as the hand wheel 40 with only pully 33 being in an idle rotation condition. Under such conditions, when thread winding shaft 6 is manually rotated about the axis of screw bolt 5 from the position of FIG. 3 to that of FIG. 4, the rubber pulley 16 secured to shaft 6 is frictionally engaged with pulley 33 to initiate unitary rotation therewith. It should be noted that an arcuate slot is provided on arm cover 2 for allowing shaft 6 to move between the positions of FIG. 3 and FIG. 4.

After the thread is sufficiently wound around bobbin 13, the thread wound bobbin comes in contact with stopper 43 to prevent it from further winding operation as in a conventional manner.

Thus, according to the present invention, once the bobbin is inserted into thread winding shaft 6, main shaft 30 simultaneously stops its rotation to prevent any danger of the operator erroneously actuating the motor by actuation of the motor of the machine.

Obviously, numerous modifications and variations of the present invention are possible in light of the above teachings. It is therefore to be understood that within the scope of the appended claims, the invention may be practiced otherwise than as specifically described herein.

We claim:

1. A thread winding mechanism for a sewing machine including a motor which comprises:

a thread winding shaft, provided in an arm of the sewing machine, an upper portion thereof being extended from said arm for inserting a bobbin thereon;

a bearing member connected to said arm;

rotatable guide means disposed within said arm and including a guide member rotatably supporting thereon said thread winding shaft with said bearing member being disposed between said thread winding shaft and said guide member and being vertically movable along said thread winding shaft during bobbin insertion on said thread winding shaft;

lever means pivotally mounted on said arm and operatively connected to said bearing member of said guide means, said lever means being rotatable in response to the vertical movement of said bearing member;

a main shaft connected to said arm;

a drive pulley transmitting rotational torque from said motor of the machine to said main shaft;

clutch means normally engaging said main shaft with said drive pulley for unitary rotation therebetween; and a torque transmitting pulley secured to the lower end of said thread winding shaft for transmitting torque from said drive pulley to said thread winding shaft when said thread winding shaft is rotated about said drive means from an inoperative position to an operative position.

2. A thread winding mechanism as set forth in claim 1, wherein said torque transmitting pulley contacts with said drive pulley for unitary rotation therewith when said thread winding shaft is in said operative position to thereby be rotated by unitary rotation of said pulleys.

3. A thread winding mechanism as set forth in claim 2, wherein said lever means comprises a first lever member formed integrally with said bearing member for vertical movement therewith, a second lever member swingably connected with said arm and being in contact with said first lever member and a third lever member swingably mounted within said arm and engageable with said pawl means for disengaging said clutch means in cooperation with said second lever member upon vertical movement of said first lever member.

4. A thread winding mechanism as set forth in claim 3, which further comprises a stopper means provided on said arm of said machine adjacent to said upper portion of said thread winding shaft in its operative position for automatically stopping the rotation of said thread winding shaft when a predetermined amount of thread is wound on said bobbin.

* * * * *